United States Patent [19]

Nakahama

[11] Patent Number: 4,557,696

[45] Date of Patent: Dec. 10, 1985

[54] TILT MECHANISM FOR MARINE PROPULSION DEVICE

[75] Inventor: Ryoji Nakahama, Iwata, Japan

[73] Assignee: Sanshin Kogyo Kabushiki Kaisha, Japan

[21] Appl. No.: 565,281

[22] Filed: Dec. 27, 1983

[30] Foreign Application Priority Data

Dec. 29, 1982 [JP] Japan ..... 57-230253

[51] Int. Cl.[4] ..... B63H 5/12

[52] U.S. Cl. ..... 440/61; 440/65

[58] Field of Search ..... 440/53, 56, 58–63, 440/65; 188/312; 248/640–643

[56] References Cited

U.S. PATENT DOCUMENTS 2,953,335 9/1960 Kiekhaefer ..... 440/61

3,722,455 3/1973 Carpenter ..... 440/61

3,749,255 7/1973 Cope ..... 188/312

4,395,239 7/1983 Hall et al. ..... 440/61

FOREIGN PATENT DOCUMENTS 996 1/1982 Japan ..... 440/61

*Primary Examiner*—Trygve M. Blix

*Assistant Examiner*—Stephen P. Avila

[57] ABSTRACT

A hydraulic arrangement for controlling tilt and trim of an outboard drive. The hydraulic arrangement comprises a single cylinder assembly having two separate cylinder bores in which separate pistons are supported for reciprocation. Each piston has a piston rod that is directly connected to a corresponding element of the outboard drive so as to insure against any wear or play in the system and to afford a compact assembly.

18 Claims, 4 Drawing Figures

TILT MECHANISM FOR MARINE PROPULSION DEVICE

BACKGROUND OF THE INVENTION

This invention relates to a tilt mechanism for marine propulsion devices and more particularly to an improved tilt and trim unit for an outboard drive.

As is well known, outboard drives such as outboard motors and the outboard drive unit of an inboard-outboard assembly are normally pivotal about a horizontally disposed axis. Pivotal movement about this axis is employed to provide a trim adjustment for the position of the outboard drive and also so as to permit the outboard drive to be tilted up clear of the water. For convenience, it has been proposed to employ hydraulic arrangements for moving the outboard drive both through the trim adjustment and also for tilting the outboard drive up out of the water. Many of these hydraulic tilt and trim assemblies use a trim cylinder having a piston that engages a portion of the outboard drive and is effective to pivot it through a small range of trim adjustment positions. A further hydraulic cylinder is normally employed and which is generally connected to both the transom of the watercraft and to the outboard drive for raising the outboard drive to a tilted up position. From the nature of the prior art arrangements, it is necessary to have the piston rod of the trim cylinder in mere abutting relationship with the outboard drive. As a result, there is a likelihood of relative movement between the drive and the piston rod, particularly when it is in its extreme positions, which can result in noise, wear and other associated problems.

It is, therefore, a principal object of this invention to provide an improved tilt and trim unit for a marine drive.

It is a further object of this invention to provide an improved and simplified tilt and trim unit that will not result in the generation of noise and in which wear is minimized.

SUMMARY OF THE INVENTION

This invention is adapted to be embodied in an outboard drive assembly that includes a first element that is adapted to be affixed to an associated watercraft, a second element carrying a propulsion device such as a propeller, and means pivotally connecting the first and second elements about a pivot axis that extends generally horizontally in use. In accordance with the invention, means are provided for pivoting the second element relative to the first element which include housing means defining a first cylinder bore portion and a second cylinder bore portion. A first piston is slidably supported in the first cylinder bore portion and is fixed for movement with a first piston rod. The first piston rod is pivotally connected to the first element. A second piston is slidably supported in the second cylinder bore portion and is affixed to a second piston rod. The second piston rod is pivotally connected to the second element so that movement of the pistons relative to the respective cylinder bore portions will effect pivotal movement of the first and second elements.

DETAILED DESCRIPTION OF THE PREFERRED EMBODIMENT

Figure 1:
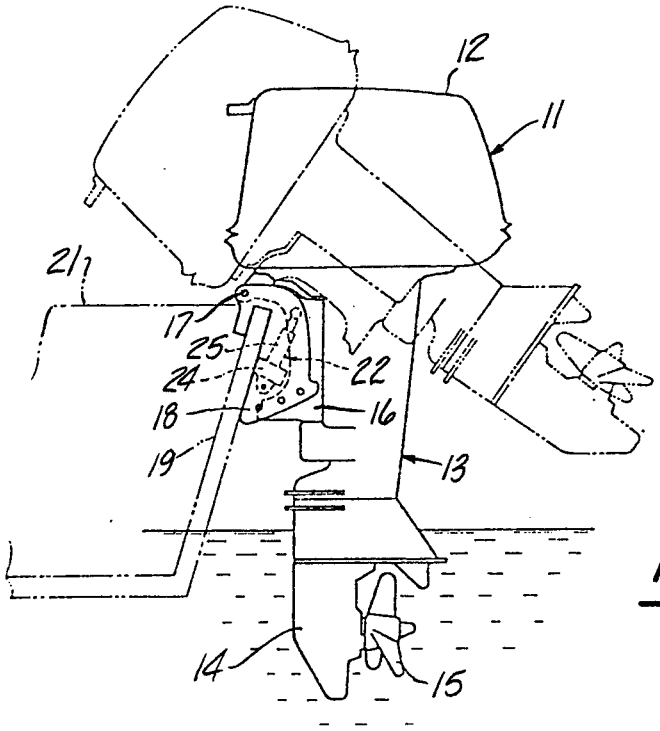
FIG. 1 is a side elevational view of an outboard motor and associated watercraft having a tilt and trim unit constructed in accordance with the invention.

Referring first to FIG. 1, an outboard motor having a tilt and trim unit constructed in accordance with this invention is identified generally by the reference numeral 11. Although the invention is described in conjunction with an ouboard motor, as has been noted, it can be equally as well practiced in connection with the outboard drive portion of an inboard-outboard arrangement. The application of the invention to such an outboard drive of an inboard-outboard unit is believed to be readily obvious to those skilled in the art.

The outboard motor 11 includes a power head 12 in which an internal combustion engine is positioned. The engine drives a drive shaft that is rotatably journaled in a drive shaft housing 13 and which terminates in a lower unit 14 in a known manner. The drive shaft drives a propulsion device carried by the lower unit 14, in this case a propeller 15, in a known manner.

The drive shaft housing 13 is supported for steering movement about a vertically extending axis by means of a swivel bracket 16. The swivel bracket 16 is, in turn, supported for pivotal movement about a horizontally extending axis by means of a pivot pin 17 and clamping bracket 18. As is well known, the clamping bracket 18 permits attachment of the motor 11 to a transom 19 of a watercraft 21 (shown in phantom). The construction of the clamping bracket 18, swivel bracket 16 and the steering and tilting construction of the motor 11 are not described in any more detail because this portion of the construction is conventional.

Figure 2:
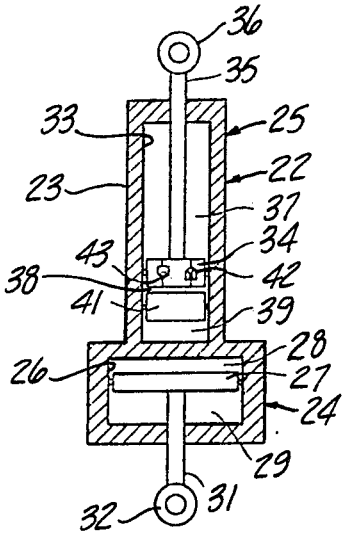
FIG. 2 is an enlarged cross-sectional view taken through the tilt and trim cylinder of the embodiment of the invention.

A hydraulic tilt and trim assembly, indicated generally by the reference numeral 22 and constructed in accordance with the invention is inerposed between the clamping bracket 18 and the swivel bracket 16 for controlling both the trim and tilt of the motor 11. The tilt and trim unit 22 is shown in cross-section in FIG. 2 and the hydraulic control circuit for it is shown schematically in FIGS. 3 and 4. The tilt and trim unit 21 includes an outer housing assembly 23 that defines a lower, trim cylinder portion, indicated generally by the reference numeral 24. Coaxially disposed with the trim cylinder portion 24, the housing assembly 23 defines a tilt cylinder assembly, indicated generally by the reference numeral 25. As will become more apparent, the trim cylinder 24 is operative to control small pivotal movements of the motor 11 so as adjust the trim position of the motor while the tilt cylinder assembly 25 is operative to tilt the motor 11 up out of the water as shown in the phantom line view in FIG. 1.

The trim cylinder assembly 24 includes a cylinder bore 26 of relatively large diameter formed in the lower portion of the housing 23. A piston 27 is slidably supported for reciprocation in the bore 26 and divides it into an upper chamber 28 and a lower chamber 29. A piston rod 31 is affixed to the underside of the pisont 27 and extends through the lower chamber 29 an outwardly through the lower end of the housing 23. A suitable seal is provided between the piston rod 31 and the cylinder housing 23. The lower end of the piston rod 31 is formed with an eyelet 32 so as to afford a detachable pivotal connection to a suitable portion of the clamping bracket assembly 18.

The tilt cylinder assembly 22 includes a cylinder bore 33 that is formed in the housing 23 concentrically with but hydraulically isolated from the cylinder bore 26. The cylinder bore 33 is of a substantially smaller diameter than the cylinder bore 22, however, the bore 33 extends for a substantially greater axial direction than does the bore 26. A piston 34 is slidably supported within the bore 33 and has a piston rod 35 that extends through the upper end of the cylinder assembly 23 and which is suitably sealed in the area where it passes through the upper end of the cylinder assembly 23. The piston rod 35 is formed with an eyelet 36 that is adapted to pass a pin for pivotally connecting the piston rod 35 to the swivel bracket 16.

The piston 34 divides the cylinder bore 33 into an upper chamber 37 and a lower chamber. The lower chamber itself is divided into an upper part 38 and a lower part 39 by means of a floating piston 41. The piston 41 is relatively freely floatable within the lower chamber and is operable, as will be apparent, so as to provide a further range of trim adjustment.

In addition to providing tilting action, the tilt cylinder assembly 25 provides hydraulic damping and reverse lock operation. For this purpose, a pair of passages are formed in the piston 34 for permitting flow between the upper chamber 37 and the upper portion 38 of the lower chamber. These passages are valved and include a pressure responsive absorber valve 42 of the check type that permits flow from the chamber 37 into the lower chamber upper portion 38 in response to a predetermined force tending to cause the motor 11 to tilt or pop up. The amount of the force necessary to open the valve 42 is set, as is well known, to the desired value. Return flow from the lower chamber portion 38 to the upper chamber 37 is permitted by means of a valve passage in which a return valve 43 is provided. The return valve 43 is adapted to open at a substantially lower pressure than the absorber valve 42, for example, the pressure generated by the weight of the outboard motor 11. In this way, the piston 34 may return to its normal trim condition when the force tending to pop the motor 11 up is removed, as will become apparent.

Figure 3:
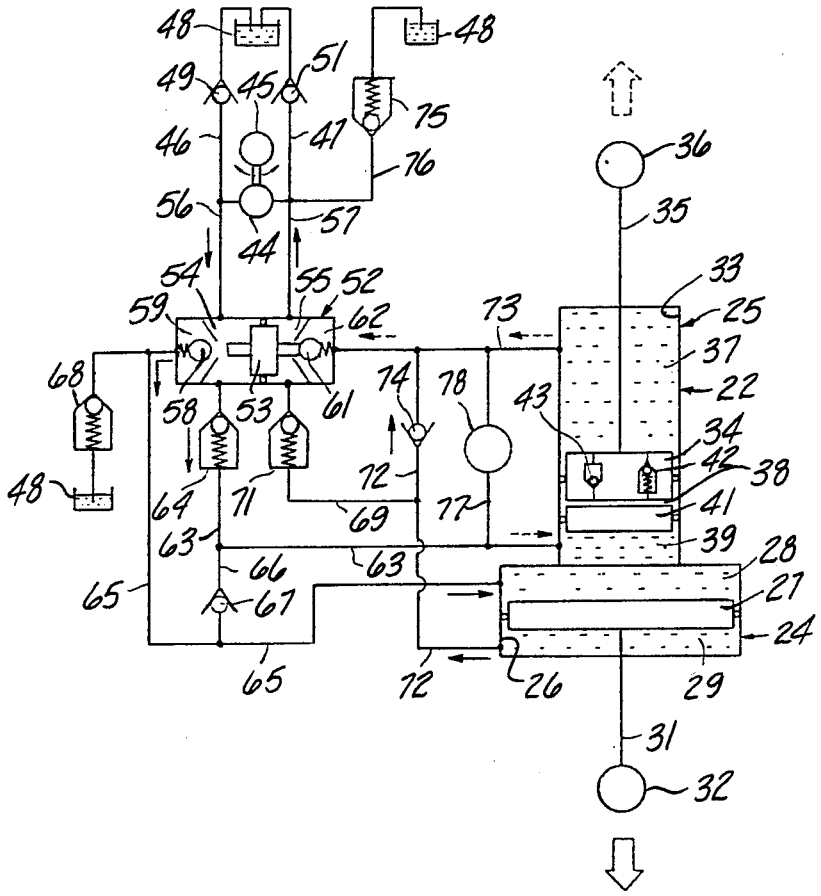
FIG. 3 is a partially schematic view showing the hydraulic system of the invention in the tilt or trim up mode.
Figure 4:
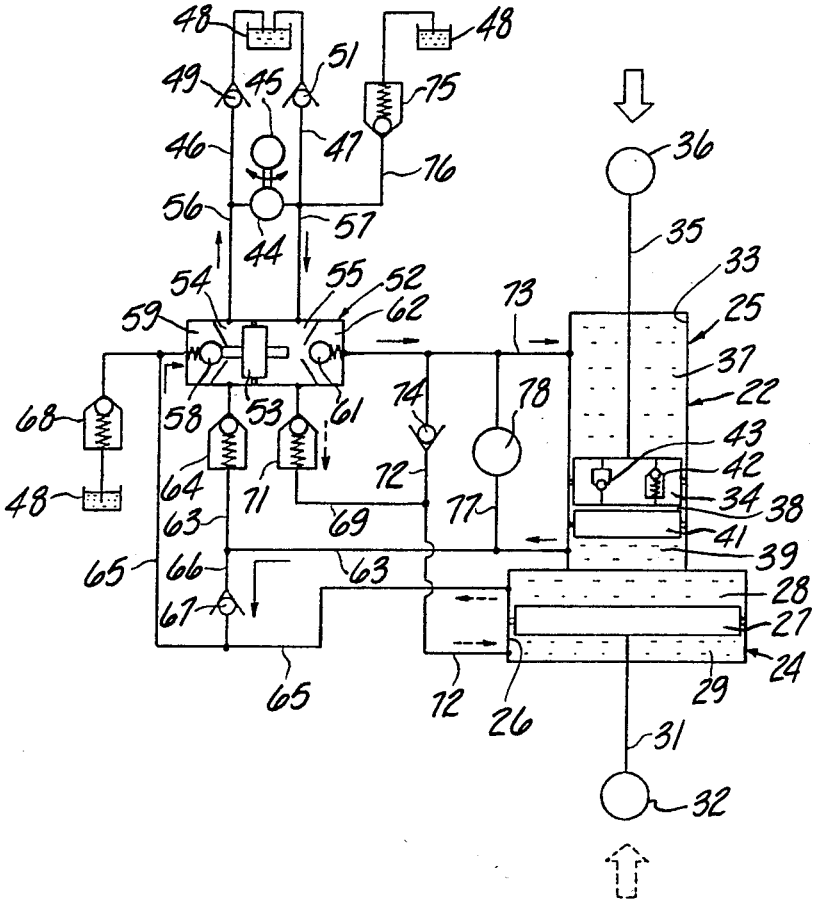
FIG. 4 is a schematic view, in part similar to FIG. 3, showing the tilt or trim down mode.

A hydraulic arrangement, shown schematically in FIGS. 3 and 4, is provided for operating the trim cylinder 24 so as to provide power up or power down trim adjustment and also so as to operate the tilt cylinder portion 22 so as to provide power up or power down tilting operation. In addition, and has been noted, the floating piston 41 may be adjusted by this hydraulic system so as to provide a further range of trim adjustment.

The hydraulic system includes a reversible, positive displacement pump, indicated schematically at 44, which is, in turn, driven by a reversible electric motor 45. The pump 44 is provided with a pair of inlet lines 46 and 47 that extend from a sump 48 and in which respective non-return check valves 49, 51 are provided.

A shuttle valve assembly, indicated generally by the reference numeral 52, is provided downstream of the pump 44 and includes a shuttle piston 53 that divides the interior of the shuttle valve into first and second chambers 54 and 55. Pressurized fluid may be delivered from the pump 44 to the chamber 54 through a pressure line 56 or returned by this same line. In a like manner, the chamber 55 communicates with the opposite side of the pump 44 through a conduit 57.

A check valve 58 is provided in the chamber 54 and controls flow into a still further chamber 59. In a similar manner, a check valve 61 controls the flow from the chamber 55 into a further chamber 62. The shuttle valve 53 has outwardly extending pin projections that are adapted to engage the balls of the check valves 58 or 61 so as to open these check valves, as will become apparent.

The chamber 54 communicates with a tilt up passage 63 in which a tilt up relief valve 64 is positioned. The tilt up relief valve 64 is adapted to open at a substantially higher pressure than the check valve 58. Passage 63 extends into the bore 33 beneath the lowermost position of the floating piston 41.

A trim up pressure line 65 extends from the shuttle valve chamber 59 to the upper or trim up side of the cylinder bore 26 in communication with the chamber 28. A line 66 in which a check valve 67 is provided communicates the lines 63 and 65 so that flow may occur from the line 63 to the line 65 in the upper side of the trim piston 27 but not in the reverse direction. A tilt pressure relief valve 68 also communicates the line 65 with the sump 48. The relief valve 68 is adapted to open at a higher pressure than the tilt up relief valve 64.

The shuttle valve chamber 55 communicates with a passage 69 in which a tilt down relief valve 71 is provided. The passage 69, in turn, communicates with a passage 72 that extends to the lower side of the trim piston 27 and specifically the chamber 29. A line 73 communicates the shuttle valve chamber 62 with the tilt cylinder assembly 25 on the side above the piston 34 and in communication with the chamber 37. The line 73 is intersected by the line 72 and a check valve 74 is provided in the line 72 so as to permit flow from the line 72 to the line 73 while precluding flow in the reverse direction.

A tilt down relief valve 75 is provided in a line 76 that communicates the junction of the lines 47 and 57 with the sump 48 so as to provide tilt down relief as will be described.

In order to provide manual tilt and trim adjustment, a line 77 communicates the tilt piston chambers 37 and 39 with each other. A manually operated valve 78 is provided in the line 77 for either opening or closing this communication under manual operation.

Operation

FIG. 3 shows the condition of the mechanism during the trim up and tilt up mode. Assuming that the motor 11 is at a normal running position and that the manual valve 78 is closed, if the operator desires to provide a trim up adjustment, through a suitable control, he operates the motor 45 so as to drive the pump 44 in a direction wherein the line 56 is pressurized and the line 57 acts as a return line. When the line 56 is pressurized, the pressure in the chamber 54 will exceed the pressure in the chamber 55 and the shuttle piston 53 of the shuttle valve assembly 52 will be forced to the right from its previous neutral position. When the shuttle piston 53 is shifted to the right, its projection will unseat the ball check valve 61 and open communication between the shuttle valve chambers 55 and 62.

Pressurization of the chamber 54 causes the ball check valve 58 to open. As has been previously noted, the check valve 58 opens at a substantially lesser pressure than the relief valves 64 and 68. Therefore, the line 65 will be pressurized so that the trim cylinder chamber 28 will be pressurized. Fluid in the chamber 29 below the trim piston 27 will be discharged through the line 72 past the check valve 74 into the line 73 for return to the input side of the pump 44 through the shuttle piston chambers 62 and 55 and the line 57. Thus, the upper side of the trim piston 27 will be pressurized whereas the lower side will be exposed to the sump or pump inlet and the piston 27 will be drive downwardly in the bore 26. Since the fluid is trapped on opposite sides of the tilt piston 34, the entire cylinder assembly 22 including the piston rod 35 will be driven upwardly at the same time the piston 27 is driven downwardly, and the desired trim adjustment may be effected.

It should be noted that the larger diameter of the trim piston 23 than the tilt piston 34 causes the trim motion to be made at a relatively low rate of speed but with a relatively high force being applied to the motor 11.

If it is desired to tilt the motor up, the pump 56 is continued to be driven in the direction shown in FIG. 3 so that the trim piston 27 will travel to the end of its stroke and contact the bottom of the cylinder assembly 22. When this occurs, there will be an increase in pressure in the line 65 which acts back through the chambers 59 and 54 upon the tilt up relief valve 64. When this rise in pressure occurs, the tilt up relief valve 64 will open so that the line 63 becomes pressurized. As has been noted, the tilt up valve 64 opens at a lower pressure than the tilt up relief valve 68 so that the relief line to the sump 48 will not be opened at this time.

When the tilt valve 64 opens and the line 63 is pressurized, pressure will be exerted in the lower chamber 39 of the cylinder bore 33 below the floating piston 41. Hence, the floating piston is urged upwardly against the piston 34 so as to cause the piston rod 35 to extend. At this time, the motor 11 will be tilted up at a rapid rate due to the relatively small diameter of the piston 34.

When the piston 34 is driven upwardly, the fluid in the upper chamber 37 will be expelled through the line 73 into the shuttle valve chamber 62. The check valve 74 will be closed so that the fluid is returned from the chamber 62 to the chamber 55 of the shuttle valve assembly 52 for return to the pump line 57.

When the motor is tilted all of the way up, there will be a rise in the pressure in the line 63 and the tilt up relief valve 68 will open so as to return fluid to the sump 48. The operator should then discontinue operation of the pump 44 and the motor 11 will be retained in its tilted up position by the hyraulic fluid contained below the floating piston 41 in the chamber 39 and the fluid locked in the chamber 28 above the trim piston 7.

The tilt and trim down operation will now be described by reference to FIG. 4. Assuming that the motor 11 is in a tilted up condition, the piston 34 and floating piston 41 will be at the upper end of the cylinder bore 33. If the operator determines to tilt the motor down, the electric motor 45 is energized so as to drive the pump 44 in a direction to pressurize the line 57 and cause the line 56 to function as a pump return line.

When the line 57 is pressurized, the pressure in the chamber 55 of the shuttle valve assembly 52 will shift the shuttle piston 53 to the left to unseat the ball check valve 58. The pressure in the chamber 55 is sufficient to unseat the check valve 61 so as to communicate the chambers 55 and 62 with each other. The pressure required to unseat the check valve 61 is substantially less than the pressure required to unseat the tilt down valve 71 and, therefore, the line 73 will be pressurized. The check valve 74 will be held closed and pressure will be exerted in the chamber 37 above the piston 34. The piston 34 and, accordingly, the floating piston 41 will be forced downwardly and the cylinder assembly 22 will be forced upwardly and the motor 11 will tilt down.

During downward movement of the pistons 34 and 41, fluid is expelled through the line 63 past the check valve 67 to the line 65. The return pressure is experienced in the shuttle valve chamber 59 and passes through the opened valve 58 into the chamber 54 to the pump return line 56.

When the piston 34 and floating piston 41 bottom in the bore 34, the pressure in the line 73 will rise abruptly. If the pump 44 is still operated at this time, the tilt down valve 71 will then open so as to communicate the chamber 55 of the shuttle valve assembly 52 with the line 69. When the line 69 is pressurized, the check valve 74 will still be held in its closed position and pressure will be delivered to the line 72 so as to pressurize the underside of the trim piston 27. The trim piston 27 will then move upwardly causing the motor 11 to move downwardly through its trim adjustment range.

When the trim piston 27 is moved upwardly, the fluid from the chamber 28 will be expelled through the line 65 back through the same return path as from the chamber 39 of the tilt assembly 22.

When the desired position is reached, the operator again stops the motor 45 and the outboard motor 11 will be retained in the desired position by the lockage of hydraulic fluid in respective tilt and trim cylinder chambers.

If the motor 45 continues to run in the tilt down condition once both pistons 34 and 27 have reached the limits of their travel, the pressure in the line 57 will rise abruptly and the trim down relief valve 75 will open to cause fluid pressurized by the pump 44 to be returned to the sump 48 through the line 76.

It should be understood that when the assembly is in any of the various trim conditions possible through the range of movement of both the trim piston 27 and the floating piston 41, that the motor may be permitted to pop up when an underwater obstacle is struck and the operation of the piston 34 and its valves 42 and 43 will cause the motor to return to its trimmed condition in the manner previously described. In addition, the arrangement will provide sufficient resistance to reverse thrust when driving in reverse to prevent popping up of the motor 11.

If at any time it is desired to manually tilt the motor 11 up, the manually operated valve 78 may be opened so as to open the communication between the chambers 37 and 39 through the line 77. When the valve 78 is opened, an upward force on the motor 11 will cause the piston rod 35 to move upwardly and displace fluid through the line 77 to the chamber 39. This will drive the floating piston 41 upwardly. Closure of the valve 78 will then lock the motor 11 in its up position since the floating piston 41 will be locked in place. In a like manner, opening of the vale 78 can permit the motor 11 again to be lowered manually under its own weight which will effectively displace fluid from the chamber 39 to the chamber 37 through the line 77 and open valve 78 and move the floating piston 41 downwardly.

It should be readily apparent from the foregoing description that an extremely compact noise and wear free assembly is provided in which power trim and tilt up and down operation are provided with a manual control that permits manual tilt up and tilt down. The arrangement is compact, may be easily installed and has the other advantages as aforedescribed. Although an embodiment of the invention has been illustrated and described, it is believed to be readily apparent to those skilled in the art that various changes and modifications may be made, without departing from the spirit and scope of the invention as defined by the appended claims.

I claim:

1. In an outboard drive assembly comprising a first element adapted to be affixed to an associated watercraft, a second element carrying a propulsion device, means pivotally connecting said first and said second elements about a pivot axis that extends generally horizontally in use, the improvement comprising means for pivoting said second element relative to said first element comprising housing means defining a first fluid motor having a cylinder bore portion and means for selectively pressurizing said first cylinder bore portion and a second fluid motor having a cylinder bore portion fixed relative to said first cylinder bore portion and means for selectively pressurizing said second cylinder bore portion, a first piston slidably supported in said first cylinder bore portion, a first piston rod fixed for movement with said first piston, means for pivotally connecting said first piston rod to said first element, a second piston slidably supported in said second cylinder bore portion, a second piston rod fixed for movement with said second piston and means for pivotally connecting said second piston rod to said second element.

2. In an outboard drive assembly comprising a first element adapted to be affixed to an associated watercraft, a second element carrying a propulsion device, means pivotally connecting said first and said second elements about a pivot axis that extends generally horizontally in use, the improvement comprising means for pivoting said second element relative to said first element comprising housing means defining a first cylinder bore portion and a second cylinder bore portion fixed relative to said first cylinder bore portion, a piston slidably supported in said first cylinder bore portion, a first piston rod fixed for movement with said first piston, means for pivotally connecting said first piston rod to said first element, a second piston slidably supported in said second cylinder bore portion, a second piston rod fixed for movement with said second piston, and means for pivotally connecting said second piston rod to said second element, said first cylinder bore portion and said first piston having a different diameter than said second cylinder bore portion and said second piston.

3. In an outboard drive assembly as set forth in claim 2 further including means for pressurizing the cylinder bore portions on selected sides of the first and second piston for effecting reciprocation of the pistons, said means for pressurizing being effective to exert the same pressure on the pistons so that the larger diameter piston moves at a slower rate and at a higher force than the smaller diameter piston.

4. In an outboard drive assembly as set forth in claim 3 wherein the means for pressurizing includes means for sequentially pressurizing first one of the pistons on one side thereof to effect relative movement between said elements in one direction and when said one piston has moved to the end of its stroke, thereafter pressurizing the other of the pistons on the side thereof effective to cause continued movement in the same direction.

5. In an outboard drive assembly as set forth in claim 1 wherein the cylinder bore portions are coaxially with each other.

6. In an outboard drive assembly as set forth in claim 5 wherein the cylinder bore portions are hydraulically separated from each other.

7. In an outboard drive assembly as set forth in claim 6 wherein the first cylinder bore portion and first piston have a different diameter than the second cylinder portion and second piston.

8. In an outboard drive assembly as set forth in claim 7 further including means for pressurizing the cylinder bore portions on selected sides of the first and second piston for effecting reciprocation of the pistons, said means for pressurizing being effective to exert the same pressure on the pistons so that the larger diameter piston moves at a slower rate and at a higher force than the smaller diameter piston.

9. In an outboard drive assembly as set forth in claim 8 wherein the means for pressurizing includes means for sequentially pressurizing first one of the pistons on one side thereof to effect relative movement between said elements in one direction and when said one piston has moved to the end of its stroke, thereafter pressurizing the other of the pistons on the side thereof effective to cause continued movement in the same direction.

10. In an outboard drive assembly as set forth in claim 1 further including valve means providing communication between opposite sides of at least one of the pistons for permitting the elements to pivot relative to each other at a restricted rate upon the application of a predetermined force and to thereafter return to their initial position.

11. In an outboard drive assembly as set forth in claim 10 further including a floating piston supported within the bore in which the one piston reciprocates and which floating piston is adapted to engage the one piston for fixing the at normal position thereof.

12. In an outboard drive assembly as set forth in claim 11 further including manually operable valve means for selectively communicating the opposite sides of the one bore for providing for manual movement of the one element relative to the other element.

13. In an outboard drive assembly as set forth in claim 12 wherein the first cylinder bore portion and first piston have a different diameter than the second cylinder portion and second piston.

14. In an outboard drive assembly as set forth in claim 13 further including means for pressurizing the cylinder bore portions on selected sides of the first and second piston for effecting reciprocation of the pistons, said means for pressurizing being effective to exert the same pressure on the pistons so that the larger diameter piston moves at a slower rate and at a higher force than the smaller diameter piston.

15. In an outboard drive assembly as set forth in claim 14 wherein the means for pressurizing includes means for sequentially pressurizing first one of the pistons on one side thereof to effect relative movement between said elements in one direction and when said one piston has moved to the end of its stroke, thereafter pressurizing the other of the pistons on the side thereof effective to cause continued movement in the same direction.

16. In an outboard drive assembly as set forth in claim 15 wherein the cylinder bore portions are coaxially with each other.

17. In an outboard drive assembly as set forth in claim 16 wherein the cylinder bore portions are hydraulically separated from each other.

18. In an outboard drive assembly as set forth in claim 17 wherein the first cylinder bore portion and first piston have a different diameter than the second cylinder portion and second piston.

* * * * *